US009402447B2

(12) United States Patent
Hortnagl

(10) Patent No.: US 9,402,447 B2
(45) Date of Patent: Aug. 2, 2016

(54) BELT BUCKLE FOR THE RELEASABLE CONNECTION OF A BELT

(71) Applicant: ABA Hortnagl GmbH, Fulpmes (AT)

(72) Inventor: Andreas Hortnagl, Fulpmes (AT)

(73) Assignee: ABA HORTNAGL GMBH, Fulpmes (AT)

( * ) Notice: Subject to any disclaimer, the term of this patent is extended or adjusted under 35 U.S.C. 154(b) by 173 days.

(21) Appl. No.: 14/173,062

(22) Filed: Feb. 5, 2014

(65) Prior Publication Data

US 2014/0215773 A1 Aug. 7, 2014

(30) Foreign Application Priority Data

Feb. 5, 2013 (AT) ..... A 86/2013

(51) Int. Cl.
*A44B 11/25* (2006.01)
*A44B 11/26* (2006.01)

(52) U.S. Cl.
CPC ..... *A44B 11/2592* (2013.01); *A44B 11/2519* (2013.01); *A44B 11/2561* (2013.01); *A44B 11/2569* (2013.01); *A44B 11/266* (2013.01); *Y10T 24/45602* (2015.01); *Y10T 24/45623* (2015.01)

(58) Field of Classification Search
CPC ..... A44B 11/2519; A44B 11/2561; A44B 11/2569; A44B 11/2592; A44B 11/266; Y10T 24/45602; Y10T 24/45623
USPC ..... 24/629, 633
See application file for complete search history.

(56) References Cited

U.S. PATENT DOCUMENTS 4,321,734 A * 3/1982 Gandelman ..... A44C 5/2052 24/313
4,987,661 A * 1/1991 Kasai ..... A44B 11/266 24/625
5,170,539 A * 12/1992 Lundstedt ..... A44B 11/006 24/194
5,291,641 A * 3/1994 Morino ..... A44B 11/266 24/625
5,561,891 A * 10/1996 Hsieh ..... A44B 11/14 24/170
6,463,640 B1 * 10/2002 Toth ..... A44B 11/266 24/648
6,965,231 B1 * 11/2005 Cinoglu ..... A61B 5/0555 324/300
7,350,277 B1 * 4/2008 Canfield ..... A44B 11/253 24/634
8,561,268 B2 10/2013 Hortnagl
8,819,960 B2 * 9/2014 Nishida ..... A44B 11/266 24/638

(Continued)

FOREIGN PATENT DOCUMENTS

AT 506214 7/2009
AT 510489 6/2012

(Continued)

*Primary Examiner* — Robert J Sandy
*Assistant Examiner* — David Upchurch
(74) *Attorney, Agent, or Firm* — Volpe and Koenig, P.C.

(57) ABSTRACT

Belt buckle for releasable connection of a belt to another belt or object. The belt buckle has a male buckle part with a plug-in extension and a female buckle part with a receptacle, and a locking device. The plug-in extension of the male buckle part is insertable into the receptacle of the female buckle part and the buckle parts are lockable to each other in a locking state by the locking device. In the locking state, the buckle parts are arrangeable relative to each other in a neutral position, in which the locking device can be brought into an unlocking position to separate the buckle parts. The buckle parts are additionally arrangeable relative to each other in a blocking position, pivoted in relation to the neutral position, in which the locking device is blocked in a locking position to prevent the buckle parts from being separated from each other.

12 Claims, 3 Drawing Sheets

(56) References Cited

U.S. PATENT DOCUMENTS

| | | | | |
|---|---|---|---|---|
| D735,606 | S * | 8/2015 | Grant | A44B 11/266 D11/218 |
| 2002/0184742 | A1 * | 12/2002 | Casebolt | A44B 11/253 24/634 |
| 2006/0048350 | A1 * | 3/2006 | Coulombe | A44B 11/253 24/634 |
| 2010/0071173 | A1 * | 3/2010 | Hortnagl | A44B 11/2592 24/651 |
| 2014/0082902 | A1 | 3/2014 | Hortnagl | |

FOREIGN PATENT DOCUMENTS

| | | |
|---|---|---|
| EP | 2165619 | 3/2010 |
| GB | 2162889 | 2/1986 |
| WO | 045484 | 10/1998 |
| WO | 2012004931 | 1/2012 |
| WO | 2012162712 | 12/2012 |

* cited by examiner

BELT BUCKLE FOR THE RELEASABLE CONNECTION OF A BELT

INCORPORATION BY REFERENCE

The following documents are incorporated herein by reference as if fully set forth: Austrian Patent Application No. A86/2013, Filed Feb. 5, 2013.

BACKGROUND

The present invention relates to a belt buckle for the releasable connection of a belt to another belt or to another object, wherein the belt buckle has at least one male buckle part with at least one plug-in extension and at least one female buckle part with at least one plug-in-extension receptacle, and at least one locking device, wherein, in order to lock the buckle parts, the plug-in extension of the male buckle part is insertable into the plug-in-extension receptacle of the female buckle part and the buckle parts are lockable to each other in a locking state by means of the locking device.

Belt buckles of the type in question serve to releasably connect belts to each other or to releasably fasten a belt to another object. These belt buckles are used, for example, both in the sphere of mountaineering and flying, but also for working safety and the like, and have in the meantime become widely used. Belt buckles of the type in question are found, for example, in International Registered Design DM/045484 and also in EP 2 165 619 A2.

Due to the areas of use thereof, the belt buckles have to be designed to be highly dependable, and, as far as possible, inadvertent operating errors must not be able to occur, since frequently the user's life, or at least the user's health, is dependent on the error-free functioning of the belt buckles.

One possible source of danger is that of, in the locking state, the locking device being inadvertently brought from the locking position thereof into the unlocking position and thus unintentional separating of the buckle parts being able to occur.

In order to prevent this, it is known, for example from AT 510 489 B1, to provide an additional counter-latch which secures the locking device in the locking position thereof against unintentional opening.

A disadvantage of said counter-latches is that the overall construction and possibly also the operation of the belt buckle become more complicated because of them.

SUMMARY

It is the object of the invention to realize an alternative way of securing the belt buckle against undesired unlocking of the locking device with as small a number of parts as possible.

In order to achieve this object, the invention proposes that, in the locking state, the buckle parts are arrangeable relative to each other in at least one neutral position, in which the locking device can be brought into an unlocking position in order to separate the buckle parts from each other, and, in the locking state, the buckle parts are additionally arrangeable relative to each other in at least one blocking position pivoted in relation to the neutral position, wherein, in the blocking position, the locking device is blocked in a locking position in order to prevent the buckle parts from being separated from each other.

A basic concept of the invention is therefore that, in the locking state, the buckle parts can be pivoted in relation to each other and, by the buckle parts being pivoted out of the neutral position, a blocking position is automatically arrived at, in which the locking device is blocked and therefore the unintentional separation of the buckle parts from each other can no longer occur. By this means, the counter-latches known in the prior art for blocking the locking device can be completely dispensed with, and therefore a simple, but nevertheless very readily operable construction of the belt buckle having few parts is possible. It should be taken into consideration in particular here that the belt or the belts attached to the buckle parts generally ensure during actual use that the buckle parts are pivoted from the neutral position into the blocking position or one of the blocking positions. This means that, in the case of belt buckles according to the invention, an opening of the locking device and therefore a separating of the buckle parts is possible only if the buckle parts are brought beforehand purposefully into the neutral position. In this connection, particularly preferred embodiments of the invention make provision for the belt buckle to have at least two blocking positions in the locking state and for the neutral position to be arranged between the blocking positions.

In preferred embodiments of the invention, it can be provided that, in the locking state, one of the buckle parts is pivotable in the direction toward the locking device relative to the other buckle part on its path from the neutral position into the blocking position. In this context, it is also favorable if, in the locking state, the buckle parts are pivotable exclusively in one plane between the neutral position and the blocking position. Preferred embodiments of the invention provide two locking devices which, in the locking state, are located on mutually opposite sides of the plug-in extension. It is favorable if, in the locking state, one of the buckle parts is pivotable relative to the other buckle part in each case in the direction toward one of the locking devices on its path from the neutral position into the blocking position. The female buckle parts and the male buckle parts are preferably formed symmetrically with respect to an axis of symmetry. In preferred embodiments, in the locking state, the axes of symmetry of the female and male buckle parts rest on each other or lie at least parallel to each other in the neutral position. However, in the locking state and in the blocking position, the axes of symmetry are advantageously tilted in relation to each other, i.e. are arranged at an angle deviating from the parallel.

It is once again explicitly stressed at this juncture that the locking state is the state in which the male buckle part is pushed with a plug-in extension thereof into the plug-in-extension receptacle of the female buckle part to such an extent that the locking device locks the buckle parts mentioned to each other. In this locking state, the buckle parts can be pivoted to and fro relative to each other between at least one neutral position and at least one blocking position. The unlocking position of the locking device is mentioned when the locking device is in the state in which it does not lock the buckle parts to each other, which is the case in the locking position of the locking device. For the sake of completeness, it is also stressed that the belt buckle can not only have a male buckle part and a female buckle part, but also a plurality of male and/or a plurality of female buckle parts, which are correspondingly locked to one another. As already emphasized, the belt buckle can also have more than one locking device.

In preferred embodiments of the invention, in the locking state, the locking device engages in an undercut of the belt buckle, wherein the locking device can be guided out of the undercut in the neutral position and is retained in an interlocking manner in the undercut in the blocking position. The undercut can be formed in the plug-in extension of the male buckle part. In this case, the locking device is advantageously then part of the female buckle part. Of course, there are also embodiments of the invention where this is precisely the other way around. In these embodiments, the undercut is then formed in the female buckle part, i.e. in particular in the plug-in-extension receptacle thereof, and the locking device or locking devices is or are then part of the male buckle part.

Provision is preferably made for the locking device to be designed as a lever which is pivotable about a pivot axis. The locking device or the pivotable lever is advantageously spring-loaded in the direction toward the locking position. The lever preferably has a handle region on one side of the pivot axis thereof and a locking region on the side of the pivot axis opposite thereto.

The plug-in extension of the male buckle part can have a T-shaped head. The undercut or the undercuts can then be arranged in the intersection region of the T shape. An undercut is a recess which is open on at least one side, irrespective of how said recess was produced. Undercuts can be formed by machining, in a casting process, or in another known manner during the production of a component or during the subsequent treatment thereof. In preferred embodiments of the invention, the undercut, on the side on which the lever can be pivoted out of the undercut in the neutral position, is bounded by a retaining lug for the interlocking retention in the blocking position. In the case of the retaining lug, provision is advantageously made for the latter, at least in the blocking position, to be located closer to the pivot axis of the lever or of the locking device than the lowest bulge of the undercut. It is particularly preferably also provided that the male buckle part and the female buckle part each have a stop region and, in the blocking position, the stop regions bear against each other and prevent the plug-in extension of the male buckle part from penetrating deeper in the plug-in-extension receptacle of the female buckle part. These stop regions can each be formed at different locations on the male and female buckle parts. For example, they may be shaped parts of the male buckle part, in particular on the plug-in extension thereof, said shaped parts correspondingly interacting with corresponding shaped-part receptacles of the female buckle part. The locking device itself can also have corresponding stop regions. Of course, however, the stop regions can also be formed in the plug-in-extension receptacles of the female buckle part. In principle, there is a multiplicity of possible embodiments which can be realized likewise corresponding in each case to one another on the male buckle part and the female buckle part. In order to be able to carry out the pivoting according to the invention between neutral position and blocking position, it is always advantageous if, at least in the neutral position in the locking state, a corresponding clearance is available between the stop regions of the male buckle part and those of the female buckle part. In preferred embodiments, the male buckle part has a shaped part in the form of a head with a narrowed neck. In these embodiments, the female buckle part has a shaped-part receptacle which interacts therewith and has a corresponding, but somewhat larger shape such that the clearances mentioned are provided for the pivoting out of the neutral position.

A method for operating a belt buckle according to the invention can make provision for the buckle parts, in the locking state, to be pivoted into a blocking position relative to each other in order to block the locking device in said blocking position so as to prevent the buckle parts from being separated from each other in a locking position. Furthermore, provision can be made for the buckle parts to be pivoted into the neutral position relative to each other in order to be able to bring the locking device into an unlocking position in order to separate the buckle parts from each other.

BRIEF DESCRIPTION OF THE SEVERAL VIEWS OF THE DRAWINGS

Further features and details of preferred embodiments of the invention are explained with reference to the alternatives according to the invention which are shown in the figures, in which.

DETAILED DESCRIPTION OF THE PREFERRED EMBODIMENTS

Figure 1:
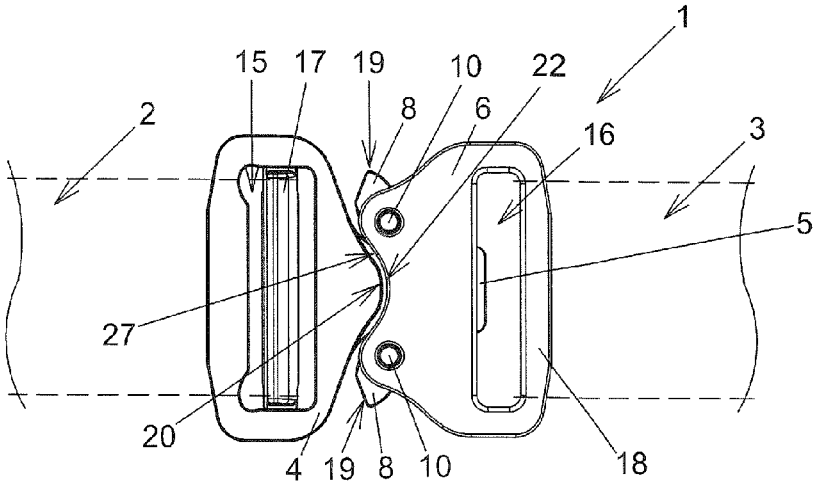
FIGS. 1 to 4 show views of a belt buckle according to the invention in the neutral position in the locking state.
Figure 2:
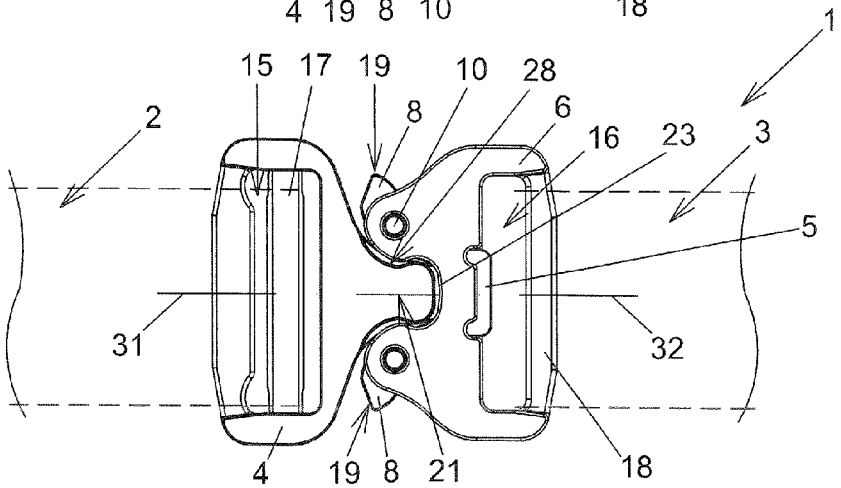

FIGS. 1 and 2 show two top views of the belt buckle 1 in the plugged together and locked state, i.e. in the locking state, in which the plug-in extension 5 of the male buckle part 4 has been pushed completely into the plug-in-extension receptacle 7 of the female buckle part 6. The locking devices 8 here are in the locking position thereof. FIGS. 1 to 4 show the neutral position in which the locking devices 8 can be brought or pivoted into the unlocking position thereof by pressure being exerted on the actuating regions 19, and therefore the male buckle part 4 can be pulled with its plug-in extension 5 out of the plug-in-extension receptacle 7 of the female buckle part 6 in order to separate the buckle parts 4 and 6 from each other. The belts 2 and 3 which are connected releasably to each other by means of the belt buckle 1 are illustrated with dashed lines. In order to be able to fasten the belts 2 and 3 to the respective buckle parts 4 and 6, the buckle parts 4 and 6 have corresponding belt receptacles 15 and 16. The latter can be in any form known from the prior art. In the first exemplary embodiment, the male buckle part 4 has an adjustable belt receptacle 15 with a displaceably mounted clamping web 17. The female buckle part 6 of said first exemplary embodiment is equipped with a fixing web 18 and is therefore not provided for adjusting the belt. Of course, exemplary embodiments according to the invention in which the adjustability of the belt receptacles 15 and 16 is swapped, the two belt receptacles 15 and 16 are adjustable or the two belt receptacles 15 and 16 are formed with corresponding fixing webs 18 are possible.

As can be seen particularly readily in the two top views according to FIGS. 1 and 2, the plug-in extension 5 of the male buckle part 4 has, on both sides, shaped parts 20 and 21 which, in the locking state illustrated, project in the corresponding shaped-part receptacles 22 and 23 of the female buckle part 6. In the neutral position illustrated in the first four figures, corresponding clearances 27 and 28 are located between the shaped parts 20 and 21, on the one hand, and the shaped-part receptacles 22 and 23, on the other hand, as a result of which the two buckle parts 5 and 6 can be pivoted relative to each other into the blocking position, which is also explained in detail further below. All this takes place in the locking state in which the locking device 8, in the locking position thereof, locks the two buckle parts 4 and 6 to each other.

Figure 3:
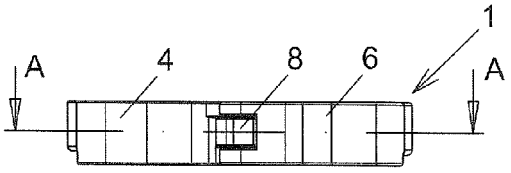
Figure 4:
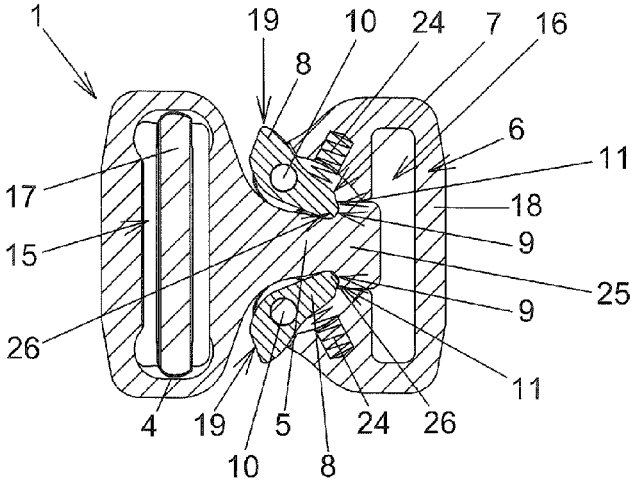
Figure 5:
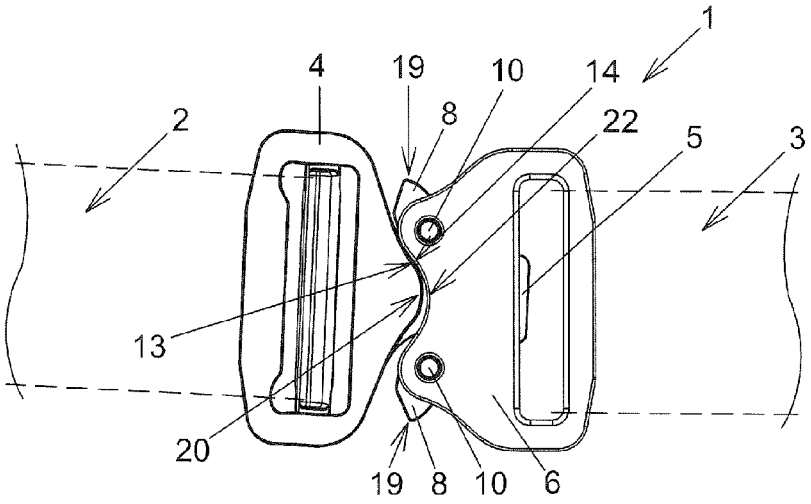
FIGS. 5 to 10 show different views of the exemplary embodiment of FIGS. 1 to 4 in a blocking position in the locking state.

FIG. 3 shows a side view of the buckle 1 in the neutral position and also the section line AA. FIG. 4 shows the section through the buckle 1 along the section line AA from FIG. 3. The belts 2 and 3 are not illustrated in FIGS. 3 and 4.

It can be seen particularly readily in the horizontal section according to FIG. 4 that the locking devices 8 of this exemplary embodiment are designed as levers which are each formed so as to be pivotable about the pivot axis 10. The actuating region 19 on which pressure can be exerted with the finger in order to bring the respective locking device 8 from the locking position illustrated in FIG. 4 into the unlocking position is located in each case on one side with respect to the pivot axis 10. Opposite the respective actuating region 19 with respect to the pivot axis 10, the locking devices 8 each have a retention region 26 with which, in the locking position illustrated, said locking devices engage in undercuts 9 of the male plug-in extension 5 in order thereby to lock the male buckle part 5 in the female buckle part 6. The pre-tensioning springs 24 which pretension the locking device 8 in each case in the direction toward the locking position thereof can also be readily seen in this exemplary embodiment. In the exemplary embodiments shown, the plug-in extension 5 of the male buckle part 4 has a T-shaped head 25. The undercuts 9 mentioned are located in the intersecting region of said T-shaped head 25.

In the neutral position shown in FIGS. 1 to 4, the locking devices 8 can be pivoted about the respective pivot axis 10 into the unlocking position thereof (not illustrated here) by pressure being exerted on the respective actuating region 19, in order thereby to be guided or pivoted out of the undercuts 9. If this is the case, the unlocking position is reached and the plug-in extension 5 can be pulled out of the plug-in-extension receptacle 7 in order to separate the male buckle part 4 from the female buckle part 6. For this purpose, in the neutral position, the male buckle part 4 can be pushed with the plug-in extension 5 thereof deeper by a certain distance into the plug-in-extension receptacle 7 so that the retention regions 26 of the locking devices 8 can be guided past the retaining lugs 11 which outwardly bound the undercuts 9.

FIGS. 5 to 10 now show a blocking position in which the locking devices 8 are likewise located in the respective locking position but can no longer be brought into the unlocking position by pressure being exerted on the actuating regions 19. As seen from the neutral position according to the FIGS. 1 to 4, the male buckle part 4 and the female buckle part 6 are pivoted relative to each other about a certain pivot angle X (see FIG. 8). In the exemplary embodiment shown, said pivoting takes place exclusively in a plane which, with respect to FIGS. 1, 2, 4, 5, 6, 8, 9 and 10, lies parallel to the respective drawing page plane. In practice, the pivoting of the buckle parts 4 and 6 relative to each other out of the neutral position into the blocking position takes place virtually automatically by means of the belts 2 and 3 attached to the buckle parts 4 and 6, and therefore a blocking position is virtually always taken up if the belt buckle 1 is not first of all brought into the neutral position for the intended unlocking and separating of the buckle parts 4 and 6 from each other. By this means, an unintentional opening or unlocking of the locking devices 8 is permanently avoided in practice without additional components.

In the blocking position, the male buckle part 4 and the female buckle part 6 of the exemplary embodiment shown bear against each other by the respective stop regions 13 and 14 thereof in such a manner that deeper penetration of the plug-in extension 5 of the male buckle part 4 into the plug-in-extension receptacle 7 of the female buckle part 6 is prevented. As stated, the stop regions 13 and 14 can be formed at different locations of the male buckle part 4 and of the female buckle part 6. These stop regions have to correspond in each case only in a manner corresponding to each other, in order, in the blocking position, to prevent further or deeper penetrating of the plug-in extension 5 into the plug-in-extension receptacle 7. In the alternative shown, the stop regions 13 and 14 are formed on the shaped parts 20 and 21 and shaped-part receptacles 22 and 23 of the male and female buckle parts 4 and 6. Furthermore, as can be seen in FIG. 8, corresponding stop regions 13 and 14 can also be provided on the locking devices 8 themselves.

Figure 7:
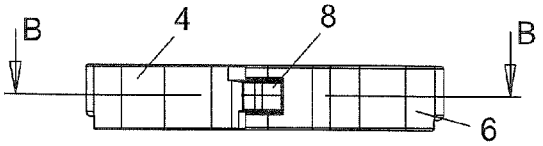
Figure 8:
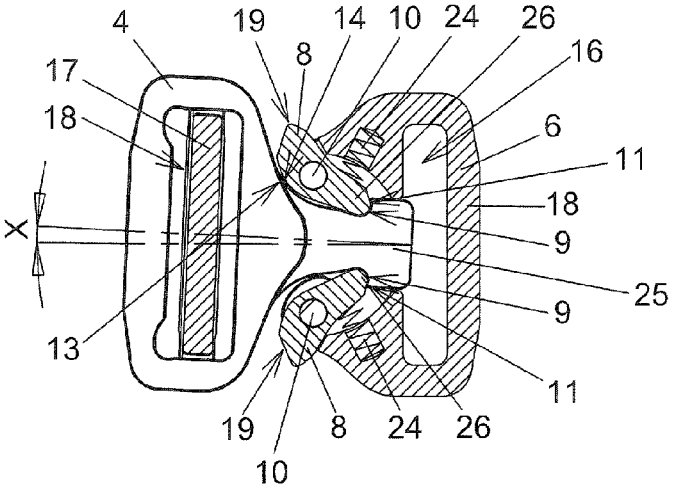

FIG. 8 shows the section BB according to FIG. 7. As stated, the buckle parts 4 and 6 are also in the blocking position in FIG. 8. It can be seen particularly readily here how the retaining lugs 11 secure the retention regions 26 of the locking devices 8 in the respective undercuts 9 in an interlocking manner. By this means, the locking devices 8, even if pressure is inadvertently exerted on the actuating regions 19, cannot be unlocked, i.e. cannot be pivoted from the locking position shown into the unlocking position (not illustrated). The retention regions 26 do not go past the retaining lugs 11, since the plug-in extension 5, as stated, cannot be pushed even deeper into the plug-in-extension receptacle 7 because of the stop regions 13 and 14 striking against each other. Unlocking of the locking device 8 is therefore possible only if the male buckle part 4 and the female buckle part 6 are pivoted back relative to each other into the neutral position shown in FIGS. 1 to 4.

Figure 6:
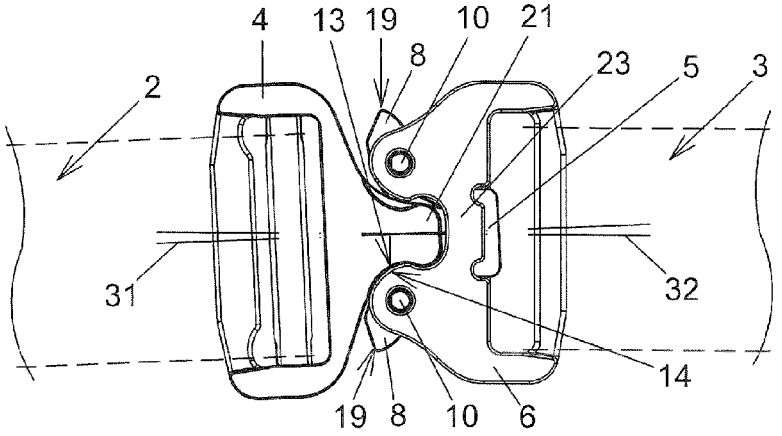

In the exemplary embodiment shown here of the belt buckle 1, the male and female buckle parts 4 and 6 are formed in a correspondingly symmetrical manner with respect to an axis of symmetry 31 and 32, drawn in in each case in FIGS. 2 and 6. The axes of symmetry 31 and 32 rest on each other in the neutral position. In the blocking positions, said axes of symmetry are arranged at an angle, i.e. are not parallel to each other.

Figure 9:
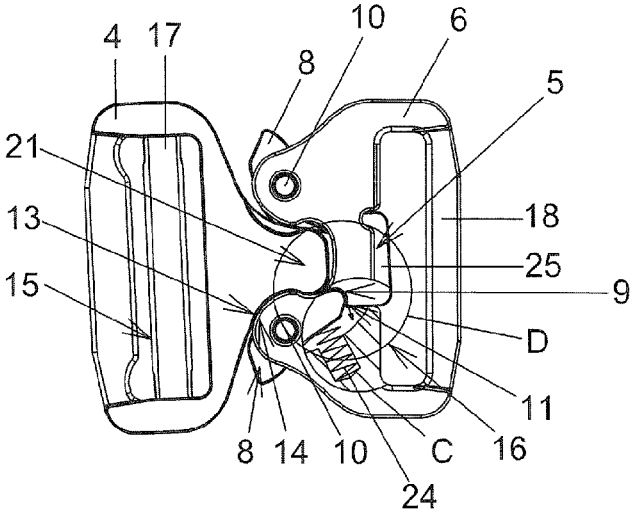
Figure 10:
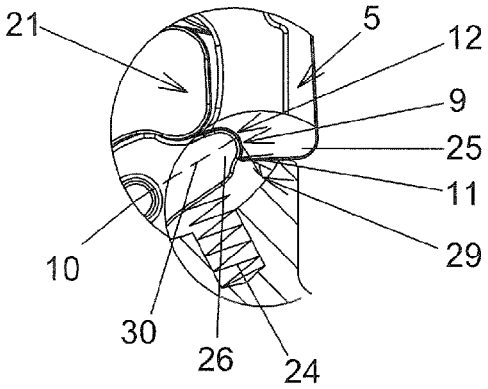

The same situation as in FIG. 6 is illustrated in FIG. 9, but the female buckle part 6 is shown in the region C partially in a sectional illustration corresponding to FIG. 8. FIG. 10 shows the region D from FIG. 9 on an enlarged scale. It can be seen here how the retention region 26, and therefore the locking device 8, is held in an interlocking manner in the undercut 9 by means of the retaining lug 11 such that opening, i.e. pivoting of the locking device 8 into the unlocking position, is not possible even when the actuating region 19 is acted upon. For this purpose, in the blocking position shown, the retaining lug 11 is closer to the pivot axis 10 than the radius 30 of the lowest bulge 12 of the undercut 9. The radius 30 is the distance between the pivot axis 10 and the mentioned lowest bulge 12. The tangent 29 to the radius 30 is also drawn in.

Figure 11:
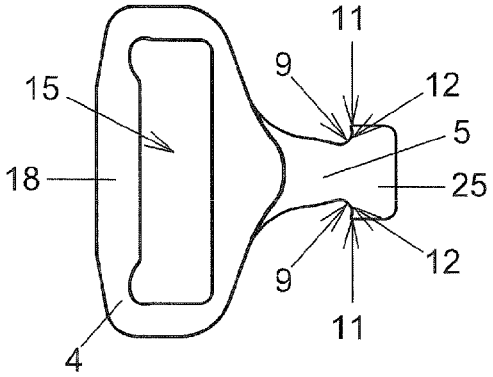
FIG. 11 shows a somewhat modified exemplary embodiment of a male buckle part formed according to the invention.

FIG. 11 shows a slightly modified exemplary embodiment of the male buckle part 4. This exemplary embodiment differs from the previously shown exemplary embodiments only in that a fixing web 18 rather than a movable clamping web 17 is formed in the belt-receiving region 15 of said male buckle part 4. Otherwise, the form of the male buckle part 4, in particular in the region and in the shaping of the plug-in extension 5, corresponds to the first exemplary embodiment.

Figure 12:
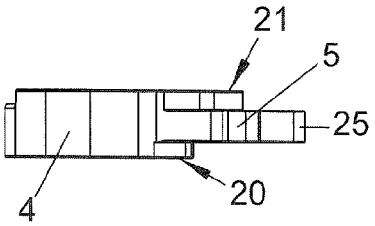
FIG. 12 shows a side view thereof.

FIG. 12 once again shows a side view of the male buckle component 4. The two shaped parts 20 and 21 can be seen particularly readily here.

| Key to the Reference numbers: | |
|---|---|
| 1 | Belt buckle |
| 2 | Belt |
| 3 | Belt |
| 4 | Male buckle part |

-continued

| Key to the Reference numbers: | |
|---|---|
| 5 | Plug-in extension |
| 6 | Female buckle part |
| 7 | Plug-in-extension receptacle |
| 8 | Locking device |
| 9 | Undercut |
| 10 | Pivot axis |
| 11 | Retaining lug |
| 12 | Lowest bulge |
| 13 | Stop region |
| 14 | Stop region |
| 15 | Belt receptacle |
| 16 | Belt receptacle |
| 17 | Clamping web |
| 18 | Fixing web |
| 19 | Actuating region |
| 20 | Shaped part |
| 21 | Shaped part |
| 22 | Shaped-part receptacle |
| 23 | Shaped-part receptacle |
| 24 | Pretensioning spring |
| 25 | T-shaped head |
| 26 | Retention region |
| 27 | Clearance |
| 28 | Clearance |
| 29 | Tangent |
| 30 | Radius |
| 31 | Axis of symmetry |
| 32 | Axis of symmetry |

The invention claimed is:

1. A belt buckle for releasable connection of a belt to another belt or to another object, comprising a male buckle part with at least one plug-in extension and a female buckle part with at least one plug-in-extension receptacle, and a locking device, wherein, in order to lock the buckle parts, the plug-in extension of the male buckle part is insertable into the plug-in-extension receptacle of the female buckle part and the buckle parts are lockable to each other in a locking state by the locking device, in the locking state, the buckle parts are arrangeable relative to each other in at least one neutral position, in which the locking device can be brought into an unlocking position in order to separate the buckle parts from each other, and, in the locking state, the buckle parts are additionally arrangeable relative to each other in at least one blocking position pivoted in relation to the neutral position, and in the blocking position, the locking device is blocked in a locking position in order to prevent the buckle parts from being separated from each other; and wherein, in the locking state, one of the buckle parts is pivotable in a direction toward the locking device relative to the other buckle part on a path from the neutral position into the blocking position.

2. The belt buckle according to claim 1, wherein, in the locking state, the buckle parts are pivoted exclusively in one plane between the neutral position and the blocking position.

3. The belt buckle according to claim 1, wherein, in the locking state, the belt buckle has at least two of the blocking positions, and the neutral position is arranged between the blocking positions.

4. The belt buckle according to claim 1, wherein, in the locking state, the locking device engages in an undercut of the belt buckle, and the locking device is guidable out of the undercut in the neutral position and is retained in an interlocking manner in the undercut in the blocking position.

5. The belt buckle according to claim 4, wherein the undercut is formed in the plug-in extension of the male buckle part.

6. The belt buckle according to claim 4, wherein the locking device is a lever that is pivotable about a pivot axis.

7. The belt buckle according to claim 6, wherein the undercut, on a side on which the lever can be pivoted out of the undercut in the neutral position, is bounded by a retaining lug for interlocking retention in the blocking position.

8. The belt buckle according to claim 7, wherein at least in the blocking position, the retaining lug is located closer to the pivot axis than a lowest bulge of the undercut.

9. The belt buckle according to claim 1, wherein the male buckle part and the female buckle part each have a stop region and, in the blocking position, the stop regions bear against each other and prevent the plug-in extension of the male buckle part from penetrating deeper in the plug-in-extension receptacle of the female buckle part.

10. The belt buckle according to claim 1, wherein the locking device is a lever that is pivotable about a pivot axis.

11. The belt buckle according to claim 1, wherein there are a plurality of the locking devices.

12. A belt buckle for releasable connection of a belt to another belt or to another object, comprising a male buckle part with at least one plug-in extension and a female buckle part with at least one plug-in-extension receptacle, and a locking device, wherein, in order to lock the buckle parts, the plug-in extension of the male buckle part is insertable into the plug-in-extension receptacle of the female buckle part and the buckle parts are lockable to each other in a locking state by the locking device, in the locking state, the buckle parts are arrangeable relative to each other in at least one neutral position, in which the locking device can be brought into an unlocking position in order to separate the buckle parts from each other, and, in the locking state, the buckle parts are additionally arrangeable relative to each other in at least one blocking position pivoted in relation to the neutral position, and in the blocking position, the locking device is blocked in a locking position in order to prevent the buckle parts from being separated from each other; and wherein, in the locking state, the buckle parts are pivoted exclusively in one plane between the neutral position and the blocking position.

* * * * *